US006796871B1

(12) United States Patent
Hsieh

(10) Patent No.: US 6,796,871 B1
(45) Date of Patent: Sep. 28, 2004

(54) SWINGABLE TOY

(76) Inventor: I-Ping Hsieh, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/684,159

(22) Filed: Oct. 9, 2003

(51) Int. Cl.[7] ..... A63H 21/02; A63H 1/00
(52) U.S. Cl. ..... 446/228; 446/236
(58) Field of Search ..... 446/228, 229, 446/236, 330, 331; 428/7, 10; 40/411, 430, 473, 493

(56) References Cited

U.S. PATENT DOCUMENTS 182,194 A * 9/1876 Hubbell ..... 446/228
1,641,477 A * 9/1927 Esser ..... 446/229
2,618,895 A * 11/1952 Sidney ..... 446/228
3,000,138 A * 9/1961 Tagliaferri ..... 446/229
3,331,153 A * 7/1967 Woods ..... 446/229
3,693,290 A * 9/1972 Breslow et al. ..... 446/229
3,864,868 A * 2/1975 Wolf ..... 446/229
4,664,640 A * 5/1987 Shindo et al. ..... 446/227
5,320,572 A * 6/1994 Chen ..... 446/315
5,890,945 A * 4/1999 Asami et al. ..... 446/228
6,042,449 A * 3/2000 Ishimoto ..... 446/234
6,607,420 B2 * 8/2003 Chung ..... 446/235
6,652,349 B1 * 11/2003 Wichter ..... 446/330

* cited by examiner

*Primary Examiner*—Derris H. Banks
*Assistant Examiner*—Faye Francis

(57) ABSTRACT

A toy includes a driving mechanism mounted on a rope located at an overhead position, and a doll having a top mounted on the driving mechanism. The driving mechanism includes a power box, a suspension member, and a gear set. Thus, the swingable toy can float and drift on the rope reciprocally, thereby achieving the amusement effect.

19 Claims, 9 Drawing Sheets

SWINGABLE TOY

BACKGROUND OF THE INVENTION

1. Field of the Invention

The present invention relates to a toy, and more particularly to a swingable toy that can float and drift on a rope reciprocally, thereby achieving the amusement effect.

2. Description of the Related Art

A conventional toy has a fixed structure and is not mobile, so that the conventional toy can only provide a monotonous and tedious amusement to the children without a functional variation, and cannot be adapted to have any other utility effect so that such a conventional toy cannot fit the practical requirement in the modern world to attract the children attention, thereby greatly limiting the versatility of the conventional toy.

SUMMARY OF THE INVENTION

The primary objective of the present invention is to provide a swingable toy that can float and drift on a rope reciprocally, thereby achieving the amusement effect.

In accordance with the present invention, there is provided a toy, comprising a driving mechanism mounted on a rope located at an overhead position, and including a power box, a suspension member, and a gear set, wherein:

the power box includes a housing, a transverse rod rotatably mounted in the housing, a drive gear secured on and rotated by the transverse rod, a shaft rotatably mounted in the housing, a first stepped gear secured on the shaft and meshing with the drive gear, an engaging gear secured on a side of the first stepped gear to rotate therewith, an upright shaft rotatably mounted in the housing, a first crown gear secured on a lower end of the upright shaft and meshing with the engaging gear of the first stepped gear, and a second crown gear secured on an upper end of the upright shaft;

the suspension member is rotatably mounted on the power box; and the gear set is mounted in the suspension member and includes a first driven gear meshing with the second crown gear, a second driven gear meshing with the first driven gear, a second stepped gear meshing with the second driven gear, an actuating gear secured on a side of the second stepped gear to rotate therewith and engaged on the rope, a third driven gear meshing with the second stepped gear, a scrolling wheel secured on a side of the third driven gear and having a peripheral wall urged on the rope, so that the rope is clamped between the actuating gear of the second stepped gear and the scrolling wheel of the third driven gear.

Further benefits and advantages of the present invention will become apparent after a careful reading of the detailed description with appropriate reference to the accompanying drawings.

DETAILED DESCRIPTION OF THE INVENTION

Figure 1:
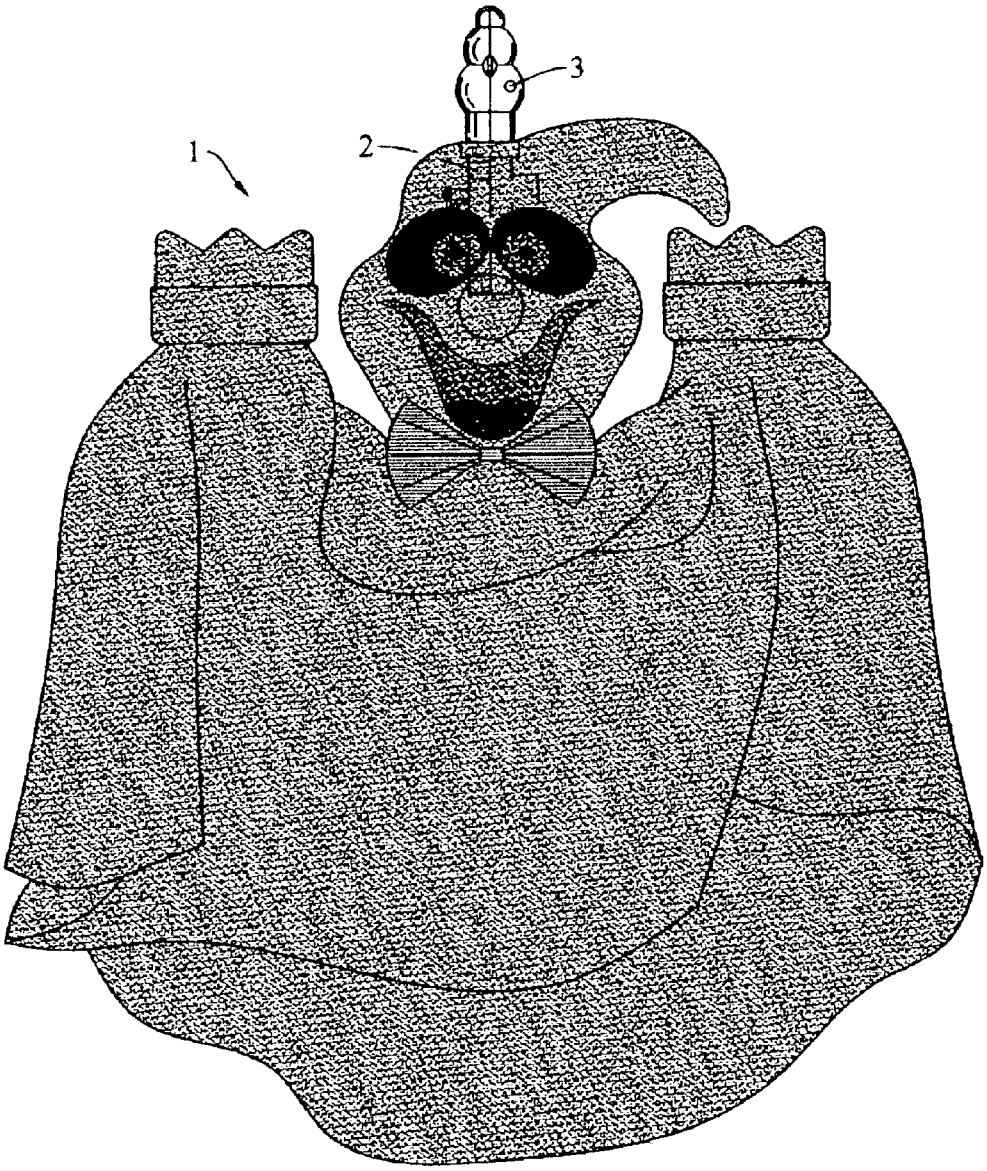
FIG. 1 is a plan view of a toy in accordance with the preferred embodiment of the present invention.
Figure 2:
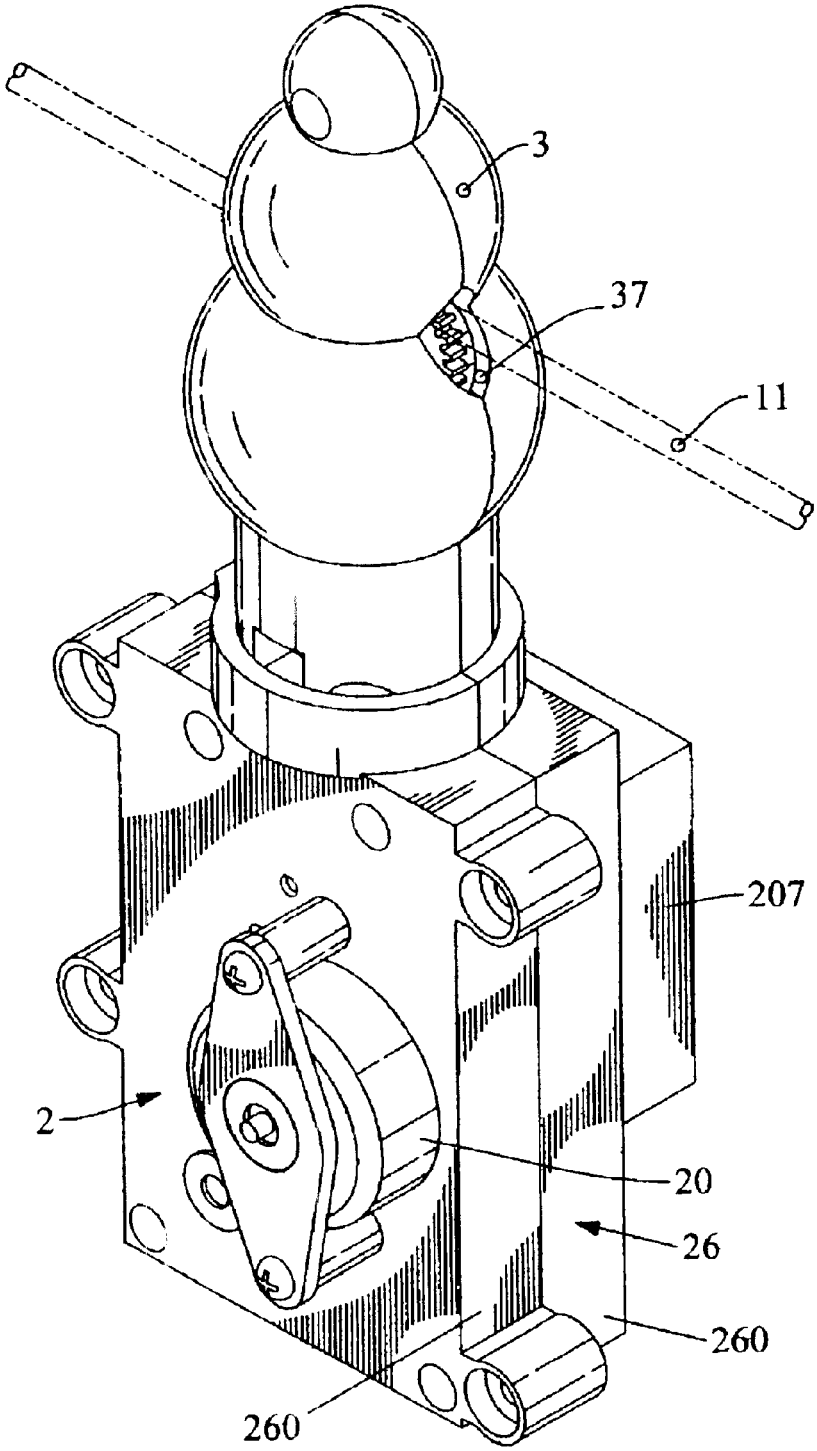
FIG. 2 is a partially perspective view of the toy in accordance with the preferred embodiment of the present invention.
Figure 3:
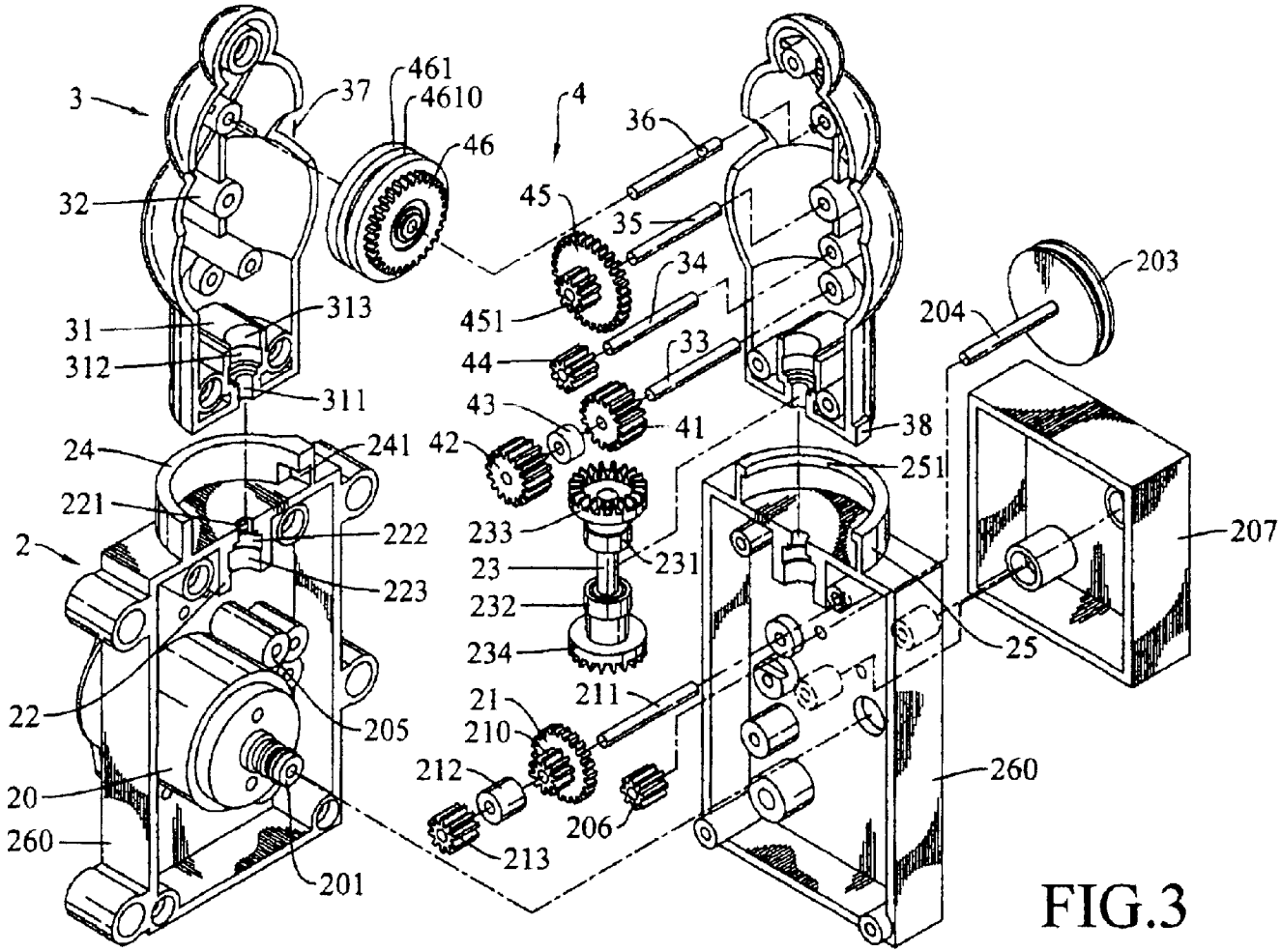
FIG. 3 is an exploded perspective view of the toy as shown in FIG. 2.
Figure 4:
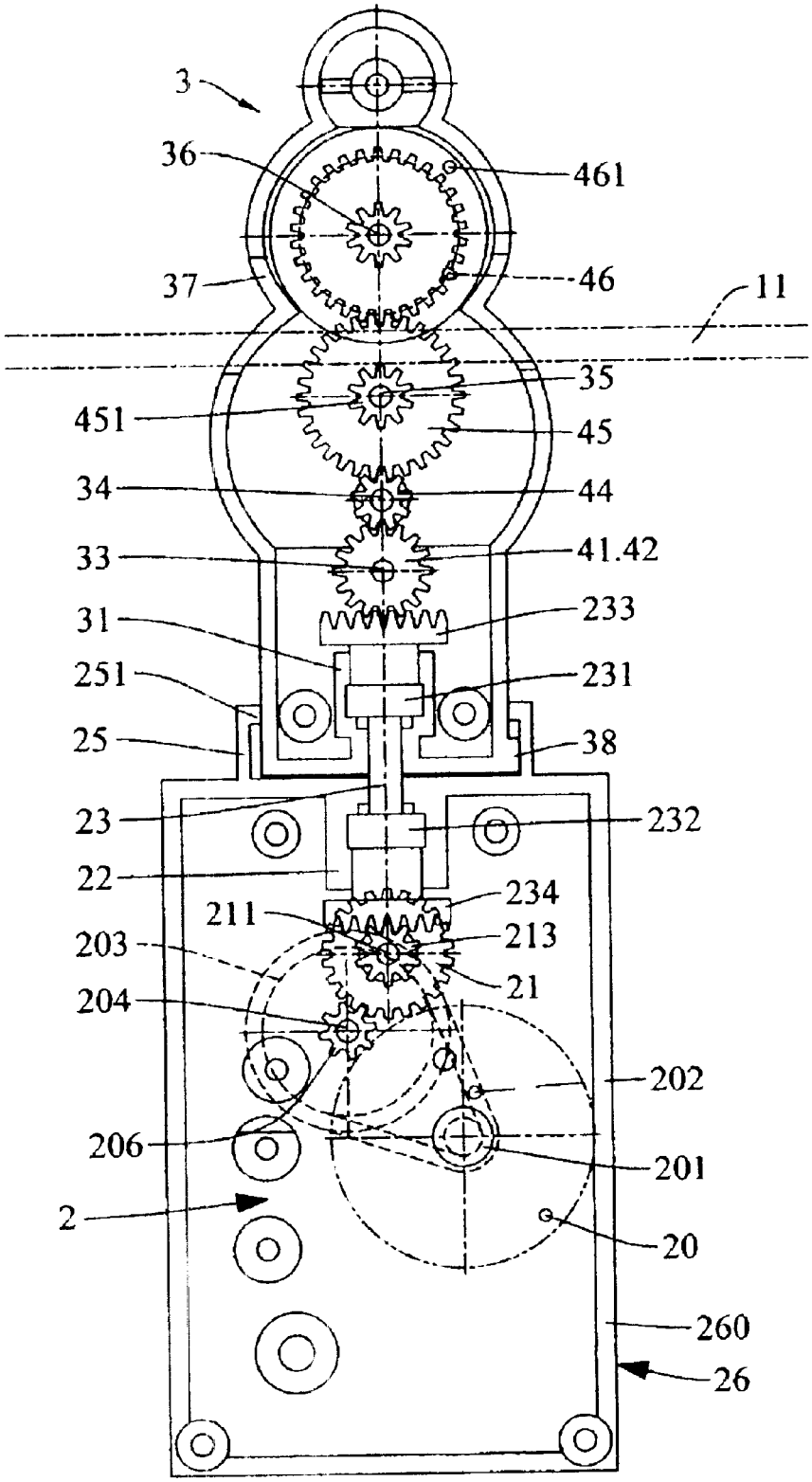
FIG. 4 is a front plan broken view of the toy as shown in FIG. 2.
Figure 5:
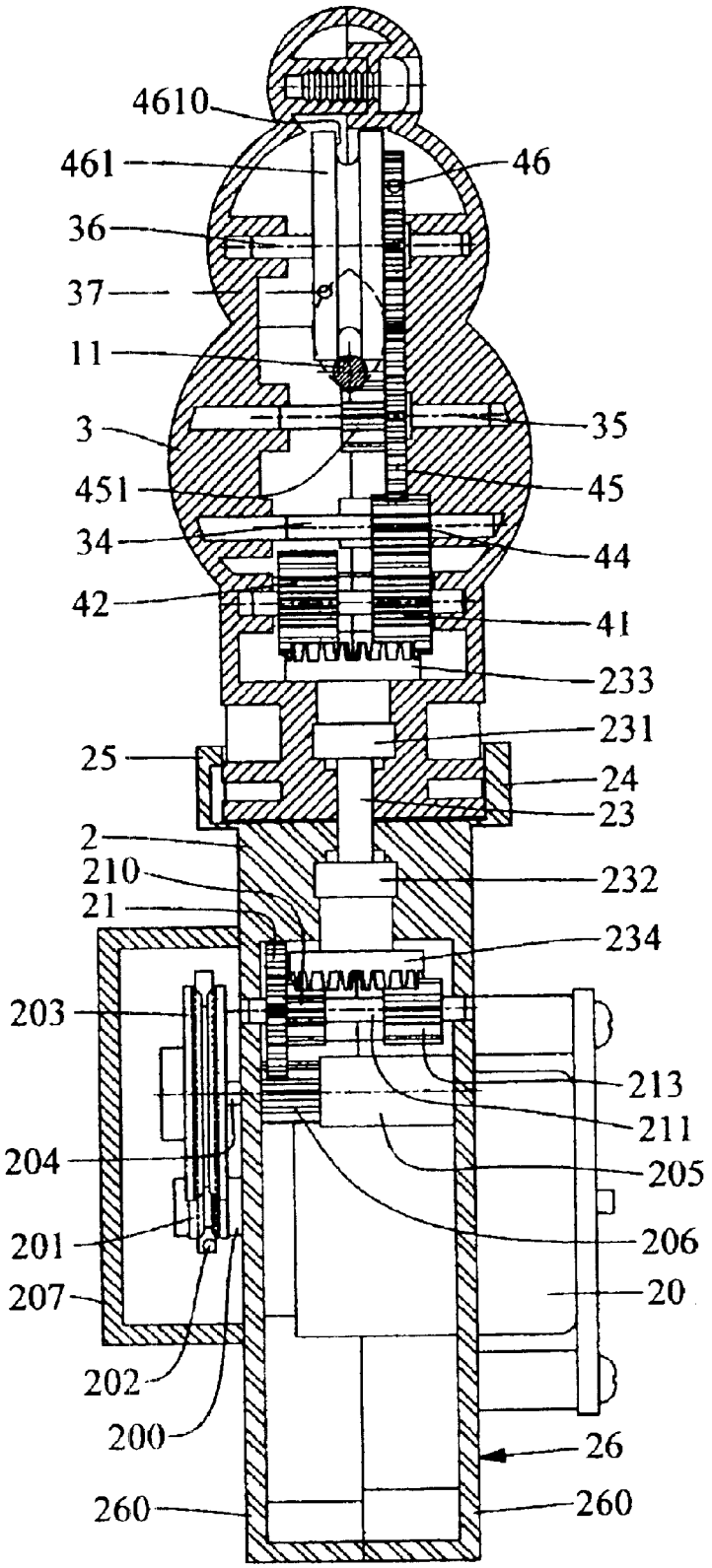
FIG. 5 is a side plan cross-sectional view of the toy as shown in FIG. 2.

Referring to the drawings and initially to FIGS. 1–5, a toy in accordance with the preferred embodiment of the present invention comprises a driving mechanism mounted on a rope 11 which is fixed at an overhead position, and a doll 1 having a top mounted on the driving mechanism.

The driving mechanism includes a power box 2, a suspension member 3, and a gear set 4.

The power box 2 includes a housing 26, a transverse rod 204 rotatably mounted in the housing 26, a drive gear 206 secured on and rotated by the transverse rod 204, a shaft 211 rotatably mounted in the housing 26, a first stepped gear 21 secured on the shaft 211 and meshing with the drive gear 206, an engaging gear 210 secured on a side of the first stepped gear 21 to rotate therewith, an upright shaft 23 rotatably mounted in the housing 26, a first crown gear 234 secured on a lower end of the upright shaft 23 and meshing with the engaging gear 210 of the first stepped gear 21, and a second crown gear 233 secured on an upper end of the upright shaft 23.

The suspension member 3 is rotatably mounted on the power box 2. The suspension member 3 has two sides each formed with a through hole 37 for passage of the rope 11.

The gear set 4 is mounted in the suspension member 3 and includes a first driven gear 41 meshing with the second crown gear 233, a second driven gear 44 meshing with the first driven gear 41, a second stepped gear 45 meshing with the second driven gear 44, an actuating gear 451 secured on a side of the second stepped gear 45 to rotate therewith and engaged on the rope 11, a third driven gear 46 meshing with the second stepped gear 45, a scrolling wheel 461 secured on a side of the third driven gear 46 and having a peripheral wall urged on the rope 11, so that the rope 11 is clamped between the actuating gear 451 of the second stepped gear 45 and the scrolling wheel 461 of the third driven gear 46. The peripheral wall of the scrolling wheel 461 of the third driven gear 46 is formed with an annular groove 4610 for receiving the rope 11.

The housing 26 of the power box 2 includes two casings 260 combined with each other. The power box 2 further includes a motor 20 mounted in the housing 26 and having a shaft 200 protruding outward from the housing 26, a first belt wheel 201 secured on the shaft 200 of the motor 20, a second belt wheel 203 secured on a first end of the transverse rod 204 for rotating the transverse rod 204, and a belt 202 mounted on the first belt wheel 201 and the second belt wheel 203, so that the second belt wheel 203 is rotated with the first belt wheel 201.

The power box 2 further includes a support column 205 secured in the housing 26, and the transverse rod 204 has a second end mounted on the support column 205. The power box 2 further includes a protective cover 207 mounted on the housing 26 to encompass the first belt wheel 201 and the second belt wheel 203. The power box 2 further includes a gear 213 secured on and rotated by the shaft 211 and meshing with the first crown gear 234, and a spacer 212 mounted on the shaft 211 and located between the drive gear 206 and the gear 213.

The power box 2 further includes a first bearing 232 mounted on the lower end of the upright shaft 23, and the housing 26 of the power box 2 has a top having a lower side formed with a support stud 22 having an upper end formed with a through hole 221 for mounting the upright shaft 23, a mediate portion formed with a cavity 222 for mounting the first bearing 232, and a lower end formed with a recess 223 for mounting the first crown gear 234.

In addition, the top of the housing 26 of the power box 2 has an upper side formed with a semi-circular first neck 24 and a semi-circular second neck 25 combined with each other. The first neck 24 of the power box 2 has an inner wall formed with a rectangular locking cavity 241, and the second neck 25 of the power box 2 has a thickness smaller than that of the first neck 24 and has an inner wall having a top formed with a flange 251.

The power box 2 further includes a second bearing 231 mounted on the upper end of the upright shaft 23, and the suspension member 3 has a bottom having an upper side formed with a support stud 31 having a lower end formed with a through hole 311 for mounting the upright shaft 23, a mediate portion formed with a cavity 312 for mounting the second bearing 231, and an upper end formed with a recess 313 for mounting the second crown gear 233.

The suspension member 3 has an inside provided with a first axle 33 on which the first driven gear 41 is secured, a second axle 34 on which the second driven gear 44 is secured, a third axle 35 on which the second stepped gear 45 and the actuating gear 451 are secured, and a fourth axle 36 on which the third driven gear 46 and the scrolling wheel 461 are secured. The inside of the suspension member 3 is provided with a support rack 32 for supporting the first axle 33, the second axle 34, the third axle 35 and the fourth axle 36. In addition, the suspension member 3 has an outer wall having a lower end formed with a rectangular lug 38 locked in the locking cavity 241 of the first neck 24 of the power box 2.

The gear set 4 further includes a gear 42 secured on the first axle 33 and meshing with the second crown gear 233, and a spacer 43 mounted on the first axle 33 and located between the first driven gear 41 and the gear 42.

Figure 6:
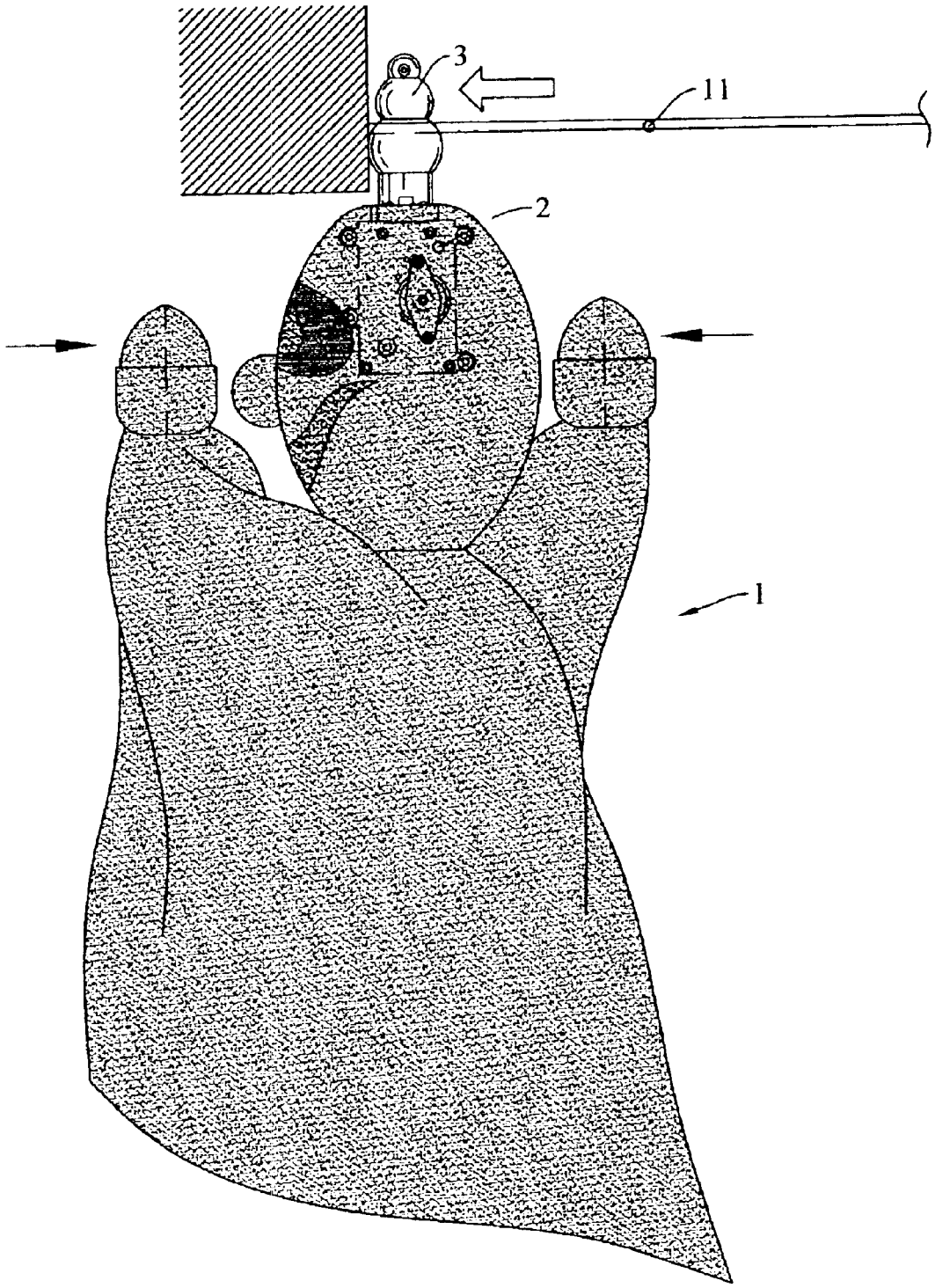
FIG. 6 is a schematic plan operational view of the toy as shown in FIG. 2.

In operation, referring to FIGS. 1–7, when the motor 20 is started, the shaft 200 of the motor 20 is rotated to rotate the first belt wheel 201 which drives the belt 202 to rotate the second belt wheel 203 which rotates the transverse rod 204 which rotates the drive gear 206 which rotates the first stepped gear 21 which rotates the engaging gear 210 and the gear 213 to rotate the first crown gear 234 which rotates the upright shaft 23 which rotates the second crown gear 233 which rotates the first driven gear 41 (and the gear 42) which rotates the second driven gear 44 which rotates the second stepped gear 45 which rotates the actuating gear 451 and the third driven gear 46, so that the actuating gear 451 of the second stepped gear 45 and the scrolling wheel 461 of the third driven gear 46 are clamped on the rope 11 and are rotated relative each other to drive the suspension member 3 to move forward on the rope 11. Thus, the doll 1 is floated and drifted on the rope 11 as shown in FIG. 6, thereby achieving the amusement effect.

Figure 7:
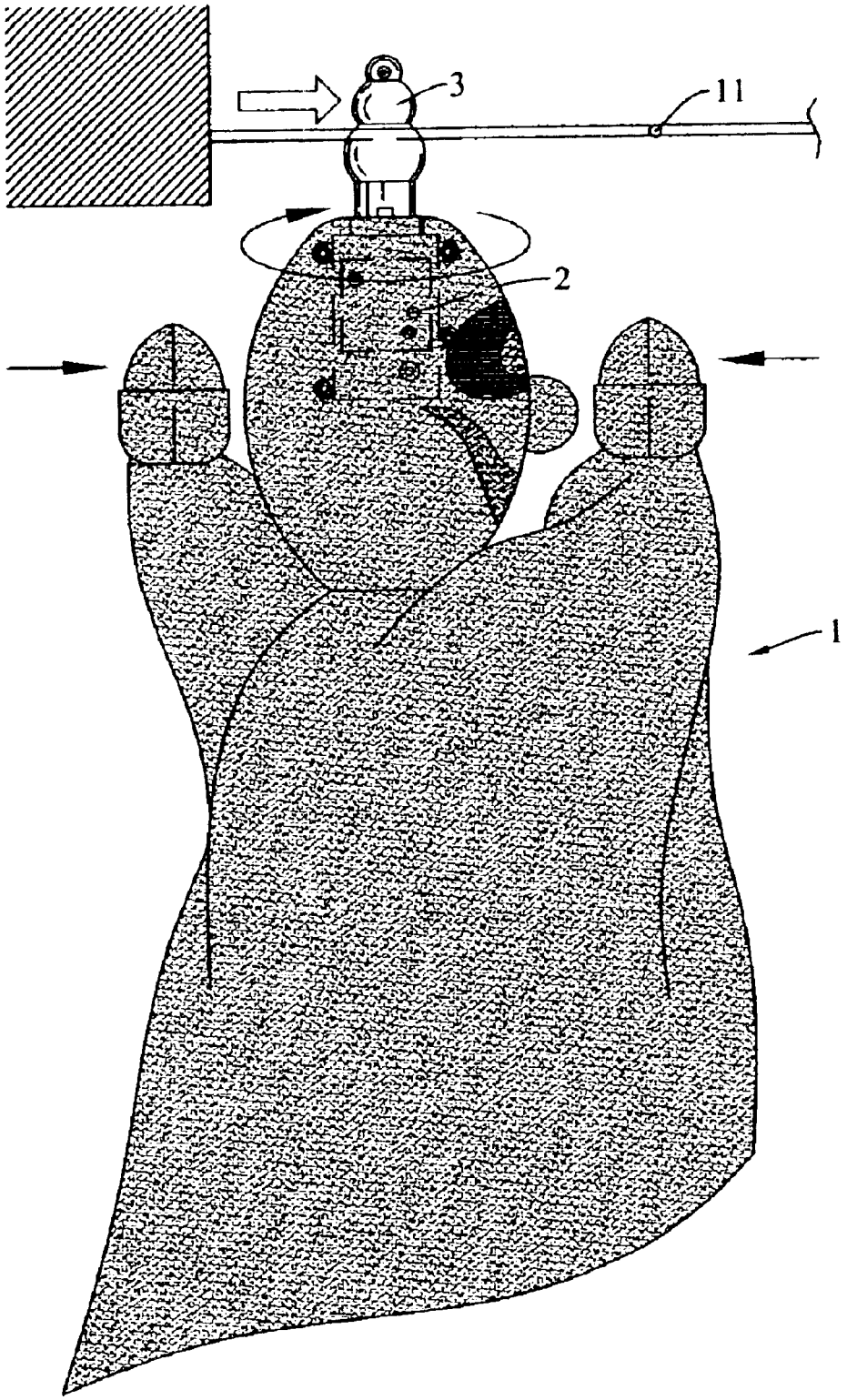
FIG. 7 is a schematic plan operational view of the toy as shown in FIG. 6.

When the doll 1 is moved to the end of the rope 11, movement of the suspension member 3 is stopped as shown in FIG. 6. At this time, the lug 38 of the suspension member 3 is locked in the locking cavity 241 of the first neck 24 of the power box 2. Thus, the successively operating motor 20 applies a torque to the power box 2, so that the power box 2 is rotated relative to the suspension member 3 through 180 degrees, and the doll 1 is turned around through 180 degrees and faces backward as shown in FIG. 7 so as to move backward successively. Thus, the doll 1 is moved on the rope 11 reciprocally, thereby achieving the amusement effect.

Figure 8:
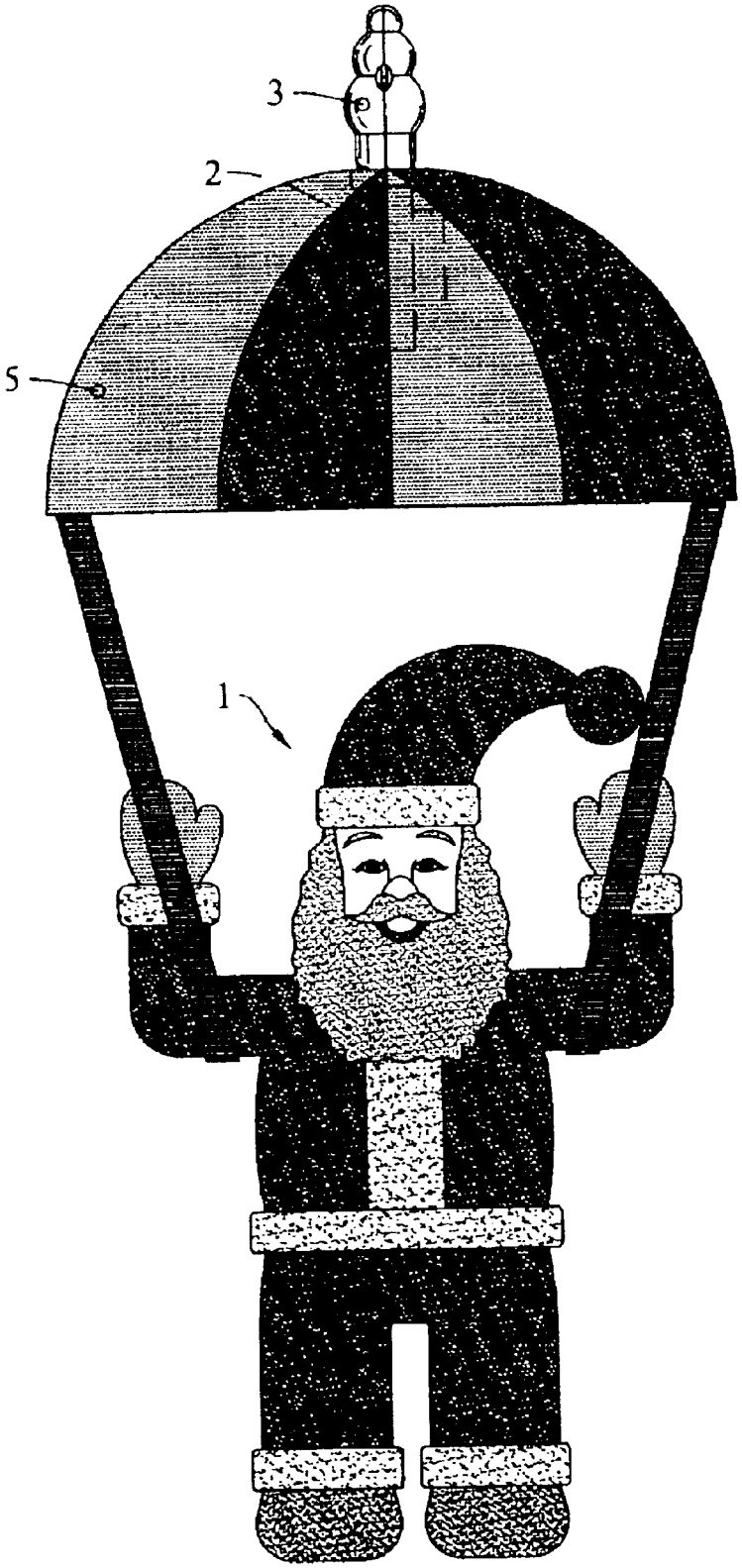
FIG. 8 is a plan view of a toy in accordance with another embodiment of the present invention.
Figure 9:
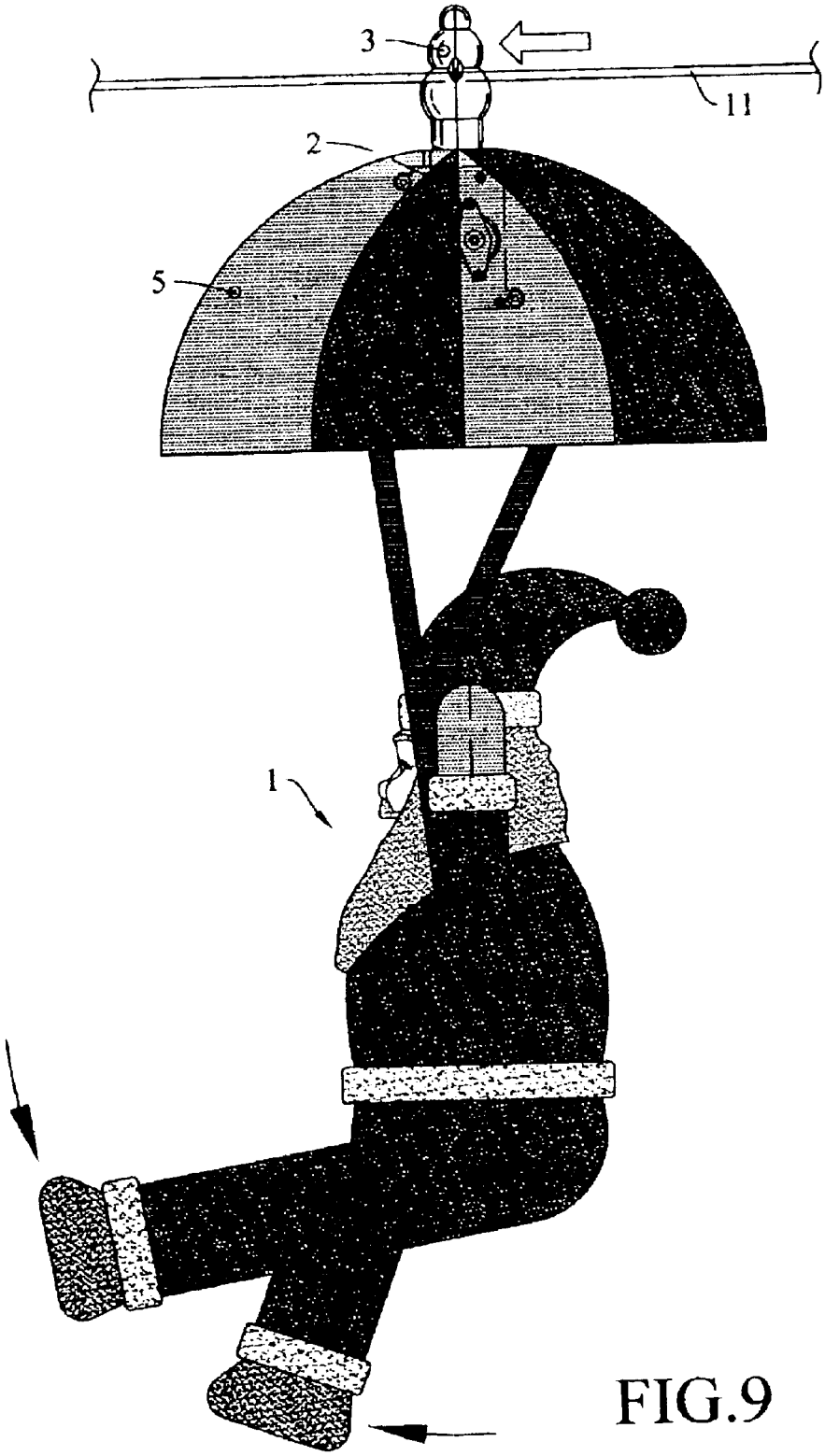
FIG. 9 is a schematic plan operational view of the toy as shown in FIG. 8.

Referring to FIGS. 8 and 9, the toy further comprises a parachute 5 mounted on the power box 2, thereby enhancing the amusement effect of the toy.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A toy, comprising a driving mechanism mounted on a rope located at an overhead position, and including a power box, a suspension member, and a gear set, wherein:

the power box includes a housing, a transverse rod rotatably mounted in the housing, a drive gear secured on and rotated by the transverse rod, a shaft rotatably mounted in the housing, a first stepped gear secured on the shaft and meshing with the drive gear, an engaging gear secured on a side of the first stepped gear to rotate therewith, an upright shaft rotatably mounted in the housing, a first crown gear secured on a lower end of the upright shaft and meshing with the engaging gear of the first stepped gear, and a second crown gear secured on an upper end of the upright shaft;

the suspension member is rotatably mounted on the power box; and the gear set is mounted in the suspension member and includes a first driven gear meshing with the second crown gear, a second driven gear meshing with the first driven gear, a second stepped gear meshing with the second driven gear, an actuating gear secured on a side of the second stepped gear to rotate therewith and engaged on the rope, a third driven gear meshing with the second stepped gear, a scrolling wheel secured on a side of the third driven gear and having a peripheral wall urged on the rope, so that the rope is clamped between the actuating gear of the second stepped gear and the scrolling wheel of the third driven gear.

2. The toy in accordance with claim 1, wherein the housing of the power box includes two casings combined with each other.

3. The toy in accordance with claim 1, wherein the power box further includes a motor mounted in the housing and having a shaft protruding outward from the housing, a first belt wheel secured on the shaft of the motor, a second belt wheel secured on a first end of the transverse rod for rotating the transverse rod, and a belt mounted on the first belt wheel and the second belt wheel, so that the second belt wheel is rotated with the first belt wheel.

4. The toy in accordance with claim 3, wherein the power box further includes a protective cover mounted on the housing to encompass the first belt wheel and the second belt wheel.

5. The toy in accordance with claim 1, wherein the power box further includes a support column secured in the housing, and the transverse rod has a second end mounted on the support column.

6. The toy in accordance with claim 1, wherein the power box further includes a gear secured on and rotated by the shaft and meshing with the first crown gear.

7. The toy in accordance with claim 6, wherein the power box further includes a spacer mounted on the shaft and located between the drive gear and the gear.

8. The toy in accordance with claim 1, wherein the power box further includes a first bearing mounted on the lower end of the upright shaft, and the housing of the power box has a top having a lower side formed with a support stud having an upper end formed with a through hole for mounting the upright shaft, a mediate portion formed with a cavity for mounting the first bearing, and a lower end formed with a recess for mounting the first crown gear.

9. The toy in accordance with claim 1, wherein the housing of the power box has a top having an upper side formed with a semi-circular first neck and a semi-circular second neck combined with each other.

10. The toy in accordance with claim 9, wherein the first neck of the power box has an inner wall formed with a rectangular locking cavity, and the suspension member has an outer wall having a lower end formed with a rectangular lug locked in the locking cavity of the first neck of the power box.

11. The toy in accordance with claim 9, wherein the second neck of the power box has a thickness smaller than that of the first neck and has an inner wall having a top formed with a flange.

12. The toy in accordance with claim 1, wherein the power box further includes a second bearing mounted on the upper end of the upright shaft, and the suspension member has a bottom having an upper side formed with a support stud having a lower end formed with a through hole for mounting the upright shaft, a mediate portion formed with a cavity for mounting the second bearing, and an upper end formed with a recess for mounting the second crown gear.

13. The toy in accordance with claim 1, wherein the suspension member has an inside provided with a first axle on which the first driven gear is secured, a second axle on which the second driven gear is secured, a third axle on which the second stepped gear and the actuating gear are secured, and a fourth axle on which the third driven gear and the scrolling wheel are secured.

14. The toy in accordance with claim 13, wherein the inside of the suspension member is provided with a support rack for supporting the first axle, the second axle, the third axle and the fourth axle.

15. The toy in accordance with claim 13, wherein the gear set further includes a gear secured on the first axle and meshing with the second crown gear.

16. The toy in accordance with claim 15, wherein the gear set further includes a spacer mounted on the first axle and located between the first driven gear and the gear.

17. The toy in accordance with claim 1, further comprising a doll having a top mounted on the driving mechanism.

18. The toy in accordance with claim 1, wherein the suspension member has two sides each formed with a through hole for passage of the rope.

19. The toy in accordance with claim 1, wherein the peripheral wall of the scrolling wheel of the third driven gear is formed with an annular groove for receiving the rope.

* * * * *